US010648254B2

(12) United States Patent
Meuth

(10) Patent No.: US 10,648,254 B2
(45) Date of Patent: May 12, 2020

(54) WRENCH ASSEMBLY WITH PROPORTIONAL GRIP CIRCUIT

(71) Applicant: FORUM US, INC., Houston, TX (US)

(72) Inventor: Joshua Brandon Meuth, Giddings, TX (US)

(73) Assignee: FORUM US, INC., Houston, TX (US)

( * ) Notice: Subject to any disclaimer, the term of this patent is extended or adjusted under 35 U.S.C. 154(b) by 87 days.

(21) Appl. No.: 15/952,579

(22) Filed: Apr. 13, 2018

(65) Prior Publication Data

US 2019/0316429 A1 Oct. 17, 2019

(51) Int. Cl.
*E21B 19/16* (2006.01)

(52) U.S. Cl.
CPC ..... *E21B 19/163* (2013.01); *E21B 19/161* (2013.01); *E21B 19/165* (2013.01)

(58) Field of Classification Search
CPC .... E21B 19/163; E21B 19/161; E21B 19/165; B25B 1/02; B25B 1/103; B25B 1/2426; B25B 13/00; B25B 13/28; B25B 13/32; B25B 13/50; B25B 13/5008; B25B 5/14; B25B 5/147; B25B 6/061; B25B 5/04; B25B 5/064; B25B 17/02; B25B 21/008; B25B 23/0014; B25B 23/1422; B25B 23/15; F02C 7/22–232; F02C 9/26; F02C 9/263; F15B 11/00; F15B 11/003; F15B 11/006; F15B 11/028; F15B 11/036; F15B 11/0365; F15B 11/05; F15B 11/16; F15B 11/165; F15B 221/00; F15B 2211/255; F15B 2211/30505; F15B 2211/3056; F15B 13/00
USPC ..... 81/57.19, 57.15; 60/39.79, 39.8, 39.81; 173/176, 178; 73/862.25
See application file for complete search history.

(56) References Cited

U.S. PATENT DOCUMENTS

| | | | | |
|---|---|---|---|---|
| 6,012,360 | A | 1/2000 | Concha | |
| 7,437,974 | B2 * | 10/2008 | Slettedal | E21B 19/164 81/57.34 |
| 9,080,582 | B2 * | 7/2015 | Fukuda | E02F 9/123 |
| 2015/0107420 | A1 * | 4/2015 | Webb | E21B 19/163 81/57.34 |
| 2018/0051527 | A1 | 2/2018 | Scekic et al. | |

FOREIGN PATENT DOCUMENTS

| | | | |
|---|---|---|---|
| DE | 19812958 | A1 | 9/1999 |
| WO | 2014/179862 | A1 | 11/2014 |
| WO | 2016/149784 | A1 | 9/2016 |

OTHER PUBLICATIONS

International Search Report and Written Opinion dated Jun. 26, 2019, corresponding to Application No. PCT/US2019/025858.

* cited by examiner

*Primary Examiner* — Orlando E Aviles
*Assistant Examiner* — Robert F Neibaur
(74) *Attorney, Agent, or Firm* — Patterson & Sheridan, L.L.P.

(57) ABSTRACT

A wrench assembly comprises upper and lower clamp assemblies each having a plurality of grip assemblies, a plurality of torqueing cylinders, and a hydraulic circuit. The hydraulic circuit is in fluid communication with the grip assemblies and the torqueing cylinders and is configured to control a gripping force applied by the grip assemblies relative to a torqueing force applied by the torqueing cylinders. The hydraulic circuit is configured to maintain the gripping force in a proportional relationship with the torqueing force.

20 Claims, 4 Drawing Sheets

WRENCH ASSEMBLY WITH PROPORTIONAL GRIP CIRCUIT

BACKGROUND

Field

Embodiments disclosed herein relate to a wrench tool for coupling or de-coupling tubulars utilized in the oil and gas industry. The wrench tool has a circuit that makes a grip force applied by the wrench tool proportional to a torque force applied by the wrench tool.

Description of the Related Art

A spinner and wrench tool (also known as a "spinner and tong") is commonly used in the oil and gas industry to rotate a tubular when making up or breaking out a threaded connection. The spinner and wrench tool rotates a tubular relative to another tubular to thread the tubulars together during a make-up operation, and rotates the tubular in an opposite direction to unthread the tubulars from each other during a break-out operation. The spinner is a relatively low torque, high speed device used for the initial makeup of a threaded connection. The wrench is a relatively high torque, low speed device that is coupled to the spinner and subsequently used to provide a greater amount of torque to complete the threaded connection.

The wrench (also known as a "power tong") may be composed of upper and lower torque bodies having a plurality of grippers that are moved into contact with the tubulars. The upper torque body is configured to rotate one of the tubulars relative to the other tubular, which is held stationary by the lower torque body, to couple or decouple the tubulars. One problem that often occurs is that the grippers grip one of the tubulars with an amount of force that tends to distort the circular shape of the tubular into an oval shape. The distortion of one of the tubular creates an amount of friction between the tubulars when coupling the tubulars together that detrimentally impacts the threaded connection. For example, the amount of friction between a box end and pin end during a make-up operation often results in a misapplication of the appropriate amount of torque required to make up the threaded connection, resulting in an incomplete threaded connection that can leak.

Therefore, there exists a need for new and/or improved wrench tools.

SUMMARY

In one embodiment, a wrench assembly comprising a lower clamp assembly having a plurality of first grip assemblies; an upper clamp assembly coupled to the lower clamp assembly, the upper clamp assembly having a plurality of second grip assemblies and a plurality of torqueing cylinders coupled thereto; and a hydraulic circuit in fluid communication with the torqueing cylinders and each of the first and second grip assemblies, wherein the hydraulic circuit is configured to control a gripping force applied by the first and second grip assemblies relative to a torqueing force applied by the torqueing cylinders such that the gripping force is proportional to the torqueing force.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure include a wrench tool for making up and breaking out a threaded connection between two tubulars. The wrench tool may be used with a spinner tool. The spinner tool is a relatively low torque, high speed device used for the initial makeup of the threaded connection. The wrench tool is a relatively high torque, low speed device that is coupled to the spinner tool and is subsequently used to provide a greater amount of torque to complete the threaded connection.

The wrench tool includes an upper clamp assembly and a lower clamp assembly. During a make-up or break-out operation, the upper clamp assembly grips and rotates one tubular, while another tubular is gripped and held stationary by the lower clamp assembly. The upper and lower clamp assemblies include independently operated grippers that grip an outer diameter of the respective tubulars. The wrench tool is used to apply a specified torque value to the threaded connection between the two tubulars.

The wrench tool as described herein includes a proportional grip circuit that limits the amount of force applied by the grippers of the lower clamp assembly to one tubular based on the amount of torque applied by the grippers of the upper clamp assembly to another tubular. The lower clamp assembly grips and holds a box end of one tubular in a stationary position, while the upper clamp assembly grips and rotates a pin end of another tubular relative to the box end to thread the tubulars together.

Figure 1:
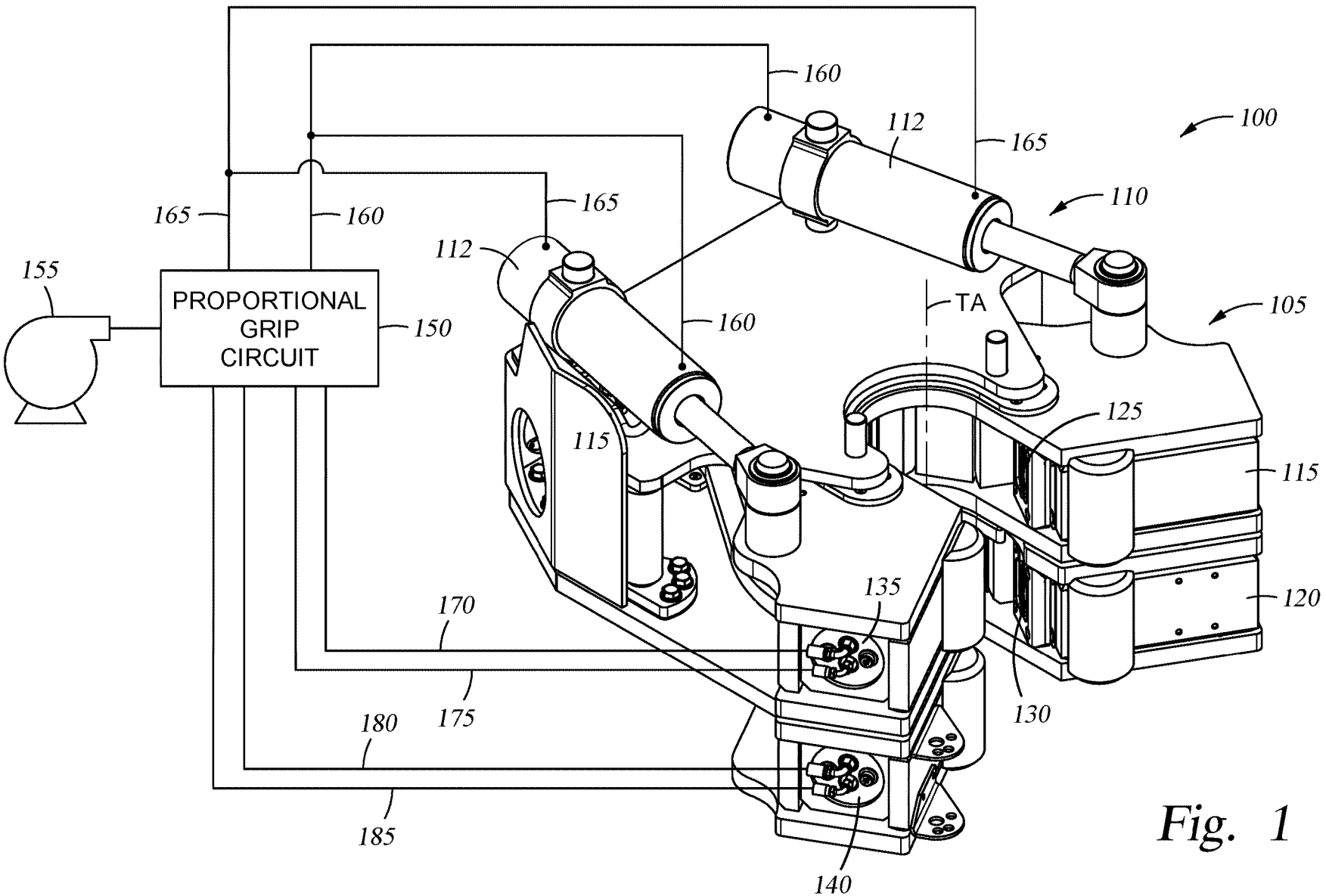
FIG. 1 is an isometric view of a wrench tool according to one embodiment.

FIG. 1 is an isometric view of a wrench tool 100 according to one embodiment. The wrench tool 100 includes a wrench assembly 105 and a proportional grip circuit 150. Although not shown, a spinner tool may be placed above the wrench assembly 105 generally in the space identified by reference numeral 110.

The wrench assembly 105 includes an upper clamp assembly 115 and a lower clamp assembly 120. The wrench assembly 105 also includes torqueing cylinders 112 that rotate the upper clamp assembly 115 relative to the lower clamp assembly 120 about a tool axis TA. The upper clamp assembly 115 and the lower clamp assembly 120 include a plurality of grip assemblies 125 and 130, respectively. Although only one grip assembly 125, 130 for each clamp assembly 115, 120 is shown, the upper and lower clamp assemblies 115, 120 can have two, three, four, or more grip assemblies 125, 130 that are equally spaced apart from each other.

The upper grip assembly 125 includes one or more upper grip actuators 135. The lower grip assembly 130 includes one or more lower grip actuators 140. The grip assemblies 130 of the lower clamp assembly 120 may be used to grip a box end of a first tubular. The grip assemblies 125 of the upper clamp assembly 115 may be used to grip a pin end of a second tubular.

In a make-up operation, the wrench tool 100 is brought into proximity with a first tubular, which may be held by a rotary spider on a rig floor for example. The grip assemblies 130 of the lower clamp assembly 120 are actuated by the lower grip actuators 140 to grip the box end of the first tubular. A pin end of a second tubular is positioned on top of the box end of the first tubular, which may be lowered by an elevator or top drive for example.

The second tubular is rotated by a spinner tool (not shown) to initially make up the threaded connection between the first and second tubulars. After the initial make up, the grip assemblies 125 of the upper clamp assembly 115 are actuated by the upper grip actuators 135 to grip the pin end of the second tubular, while the box end of the first tubular remains gripped by the lower clamp assembly 120. The upper clamp assembly 115 then is rotated by the torqueing cylinders 112 relative to the lower clamp assembly 120 to further tighten and complete the thread connection between the first and second tubulars.

To prevent the application of an excessive amount of grip force by the grip assemblies 130 of the lower clamp assembly 120, the wrench tool 100 includes a proportional grip circuit 150 that controls the amount of fluid, which dictates the pressure supplied to the lower grip actuators 140 that actuate the grip assemblies 130. The proportional grip circuit 150 is in fluid communication with a pump 155, which supplies pressurized fluid to the wrench tool 100, and specifically controls the amount of pressurized fluid supplied to the torqueing cylinders 112, the lower grip actuators 140, and the upper grip actuators 135 as further described below.

Figure 4:
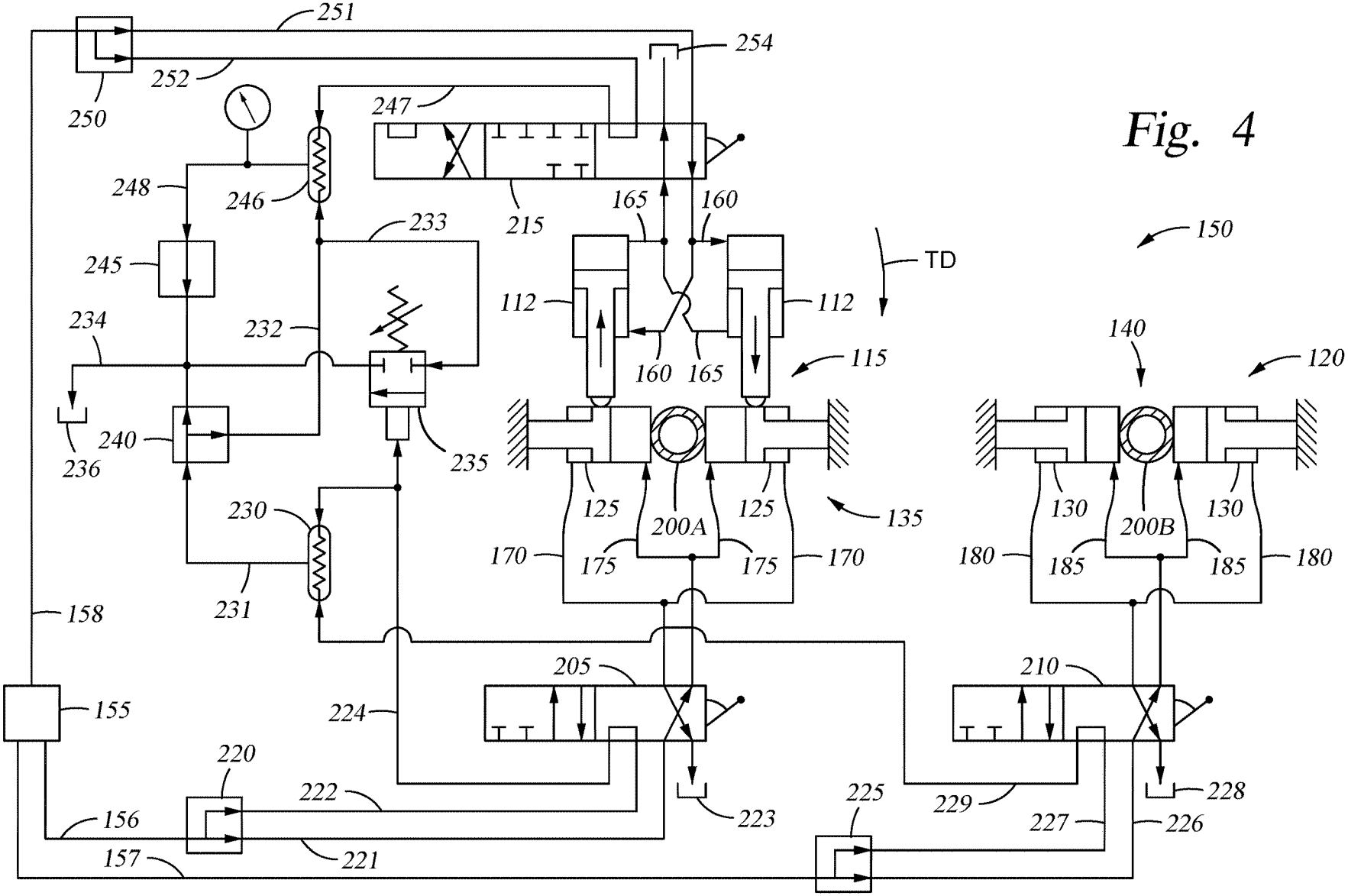
FIG. 4 is a schematic diagram of the proportional grip circuit of the wrench tool in a gripping and torqueing mode.

The torqueing cylinders 112 are in fluid communication with the proportional grip circuit 150 by fluid lines 160, 165 (which may be conduits or hoses for example) that control torque application by moving the upper clamp assembly 115 relative to the lower clamp assembly 120 in the direction of reference arrow TD (shown in FIG. 4). The proportional grip circuit 150 controls the amount and direction of pressurized fluid supplied through the fluid lines 160, 165 to actuate the torqueing cylinders 112.

The lower grip actuators 140 are in fluid communication with the proportional grip circuit 150 by fluid lines 180, 185 (which may be conduits or hoses for example) that control extension and retraction of the grip assemblies 130. The proportional grip circuit 150 controls the amount and direction of pressurized fluid supplied through the fluid lines 180, 185 to the grip actuators 140 to actuate the grip assemblies 130.

The upper grip actuators 135 are in fluid communication with the proportional grip circuit 150 by fluid lines 170, 175 (which may be conduits or hoses) that control extension and retraction of the grip assemblies 125. The proportional grip circuit 150 controls the amount and direction of pressurized fluid supplied through the fluid lines 170, 175 to the grip actuators 135 to actuate the grip assemblies 125.

Figure 2:
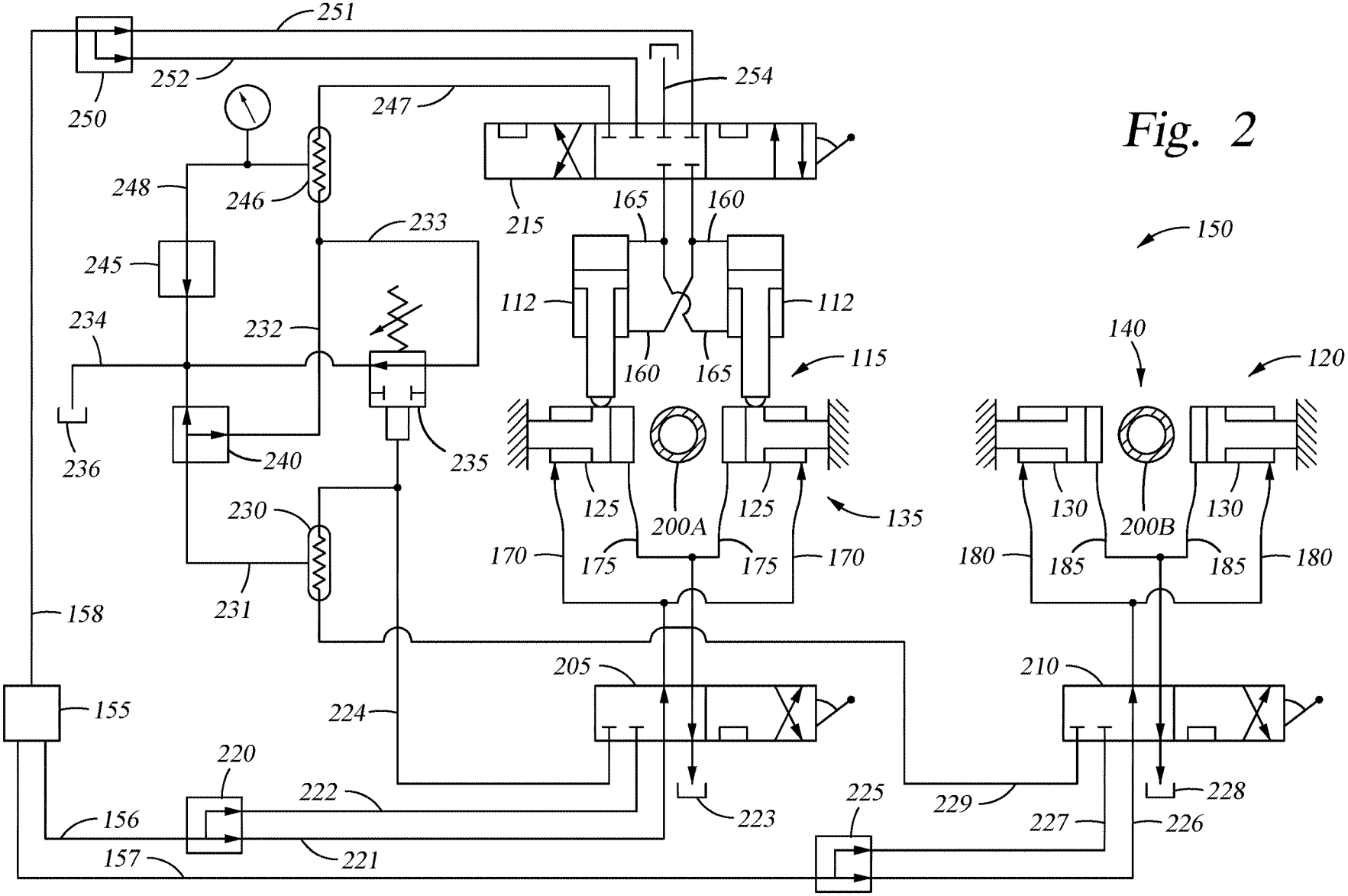
FIG. 2 is a schematic diagram of a proportional grip circuit of the wrench tool in a neutral mode.
Figure 3:
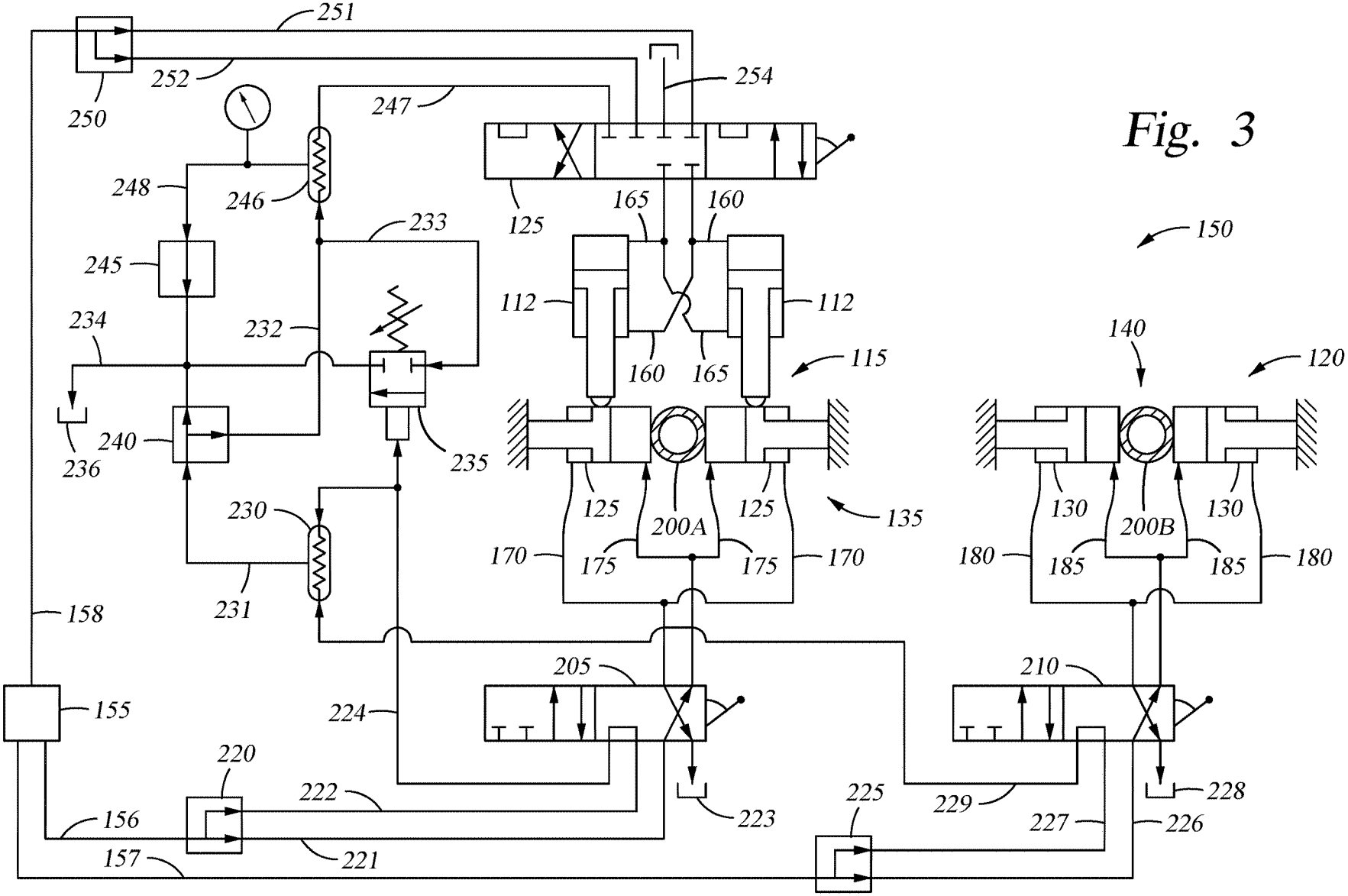
FIG. 3 is a schematic diagram of the proportional grip circuit of the wrench tool in a gripping mode.

FIGS. 2-4 are schematic diagrams illustrating one embodiment of operation of the proportional grip circuit 150. FIG. 2 is a diagram of the proportional grip circuit 150 in a neutral mode. FIG. 3 is a diagram of the proportional grip circuit 150 with the grip assemblies 125 of the upper clamp assembly 115 and the grip assemblies 130 of the lower clamp assembly 120 clamping a pin end 200A of a first tubular and a box end 200B of a second tubular, respectively. FIG. 4 is a diagram of the proportional grip circuit 150 as torque is applied to the pin end 200A of the first tubular to rotate the first tubular relative to the box end 200B of the second tubular.

While the proportional grip circuit 150 is shown and described in FIGS. 2-4 as having two grip assemblies 125 of the upper clamp assembly 115, as well as two grip assemblies 130 of the lower clamp assembly 120, the proportional grip circuit 150 may be utilized with a wrench tool having more than two grip assemblies for the upper clamp assembly 115 and the lower clamp assembly 120.

FIG. 2 shows the proportional grip circuit 150 in a neutral mode. A first grip controller 205, which controls actuation of the upper clamp assembly 115, is in fluid communication with the pump 155 via a valve 220 and fluid lines 156, 221, 222. Fluid from the pump 155 flows through fluid line 156, through valve 220, through fluid 221, and through the first grip controller 205 to supply fluid to fluid lines 170, which force the grip assemblies 125 into a retracted position such that the upper clamp assembly 115 is not gripping the pin end 200A of the first tubular. Fluid in the grip assemblies 125 may be returned to a reservoir 223 via fluid lines 175 through the first grip controller 205.

A second grip controller 210, which controls actuation of the lower clamp assembly 120, is in fluid communication with the pump 155 via a valve 225 and fluid lines 157, 226, 227. The valve 225 may be a pressure control valve, such as a remote compensator valve. Fluid from the pump 155 flows through fluid line 157, through valve 225, through fluid 226, and through the second grip controller 210 to supply fluid to fluid lines 180, which force the grip assemblies 130 into a retracted position such that the lower clamp assembly 120 is not gripping the box end 200B of the second tubular. Fluid in the grip assemblies 130 may be returned to a reservoir 228 via fluid lines 185 through the second grip controller 210.

A torque controller 215, which control actuation of the torqueing cylinders 112, is in fluid communication with the pump 155 via a valve 250 and fluid lines 158, 251, 252. As shown, the torque controller 215 is in a neutral position such that no fluid from the pump 155 is flowing to the torqueing cylinders 112 via fluid lines 251, 252. The torqueing cylinders 112 are not applying any torque to the upper clamp assembly 115.

FIG. 3 shows the proportional grip circuit 150 in a gripping mode. The first grip controller 205 is actuated so that fluid from the pump 155 is communicated from fluid line 221 to fluid line 175 to actuate the grip assemblies 125 of the upper clamp assembly 115 to grip the pin end 200A of the first tubular. The second grip controller 210 is actuated so that fluid from the pump 155 is communicated from fluid line 226 to fluid line 185 to actuate the grip assemblies 130 of the lower clamp assembly 120 to grip the box end 200B of the second tubular. The first and second grip controllers 205, 210 also place fluid lines 170, 180 in fluid communication with reservoirs 223, 228, respectively, for return fluid.

The first and second grip controllers 205, 210, when actuated, also place fluid line 222 in fluid communication with fluid line 224, and fluid line 227 in fluid communication with fluid line 229, respectively. Fluid in fluid lines 224 and 229 flows to a first check valve 230, which directs the fluid to a first relief valve 240 via fluid line 231. The check valve 230 may be a back-to-back check valve.

When pressure in the fluid line 231 exceeds a predetermined amount, the relief valve 240 opens and the fluid is dumped into a reservoir 236 via fluid line 234. The fluid can also flow into the reservoir 236 via fluid line 234 by first flowing through fluid lines 232 and 233 and a control valve 235 (as further described below). The relief valve 240 may be preset, adjusted manually, or controlled remotely to set the amount at which the relief valve 240 opens. In this manner, the relief valve 240 helps control the amount of gripping force that can be applied by the upper and lower clamp assemblies 115 and 120 to the pin end 200A and the box end 200B of the first and second tubulars, respectively.

The control valve 235, which may be a directional control valve, is an optional component of the proportional grip circuit 150 and also helps control the amount of gripping force that can be applied by the upper and lower clamp assemblies 115 and 120. The control valve 235 is biased into an open position (as shown in FIG. 2), such as by a spring, so that fluid from the relief valve 240 can flow from the fluid line 232, to the fluid line 233, through the control valve 235, to the fluid line 234, and to the reservoir 236. However, when the upper clamp assembly 115 is actuated via the first grip controller 205, fluid in the fluid line 224 forces the control valve 235 into a closed position (as shown in FIG. 3) and closes off the fluid path to the reservoir 236 via the fluid line 233.

When the control valve 235 is closed, fluid in the line 232 is directed through a second check valve 246 to a fluid line 248 and to a second relief valve 245, which is set to open when pressure in the fluid line 248 exceeds a predetermined amount. The amount of pressure needed to open the relief valve 245 adds to the amount of pressure need to open the relief valve 240 when the control valve 235 is closed. Specifically, the fluid pressure in the fluid line 232 increases the pressure setting of the relief valve 240. The maximum amount of gripping force applied by the upper and lower clamp assemblies 115, 120 is therefore increased.

For example, if the relief valve 240 is set to open at about 500 psi, and the relief valve 245 is set to open at about 1000 psi, then the maximum amount of gripping force applied by the upper and lower grip assemblies 125 and 130 would be 1,500 psi. The relief valve 245 may be preset, adjusted manually, or controlled remotely to set the predetermined amount at which the relief valve 245 opens. In this manner, the gripping force applied by the upper and lower clamp assemblies 115, 120 can also be adjusted by adjusting the amount of pressure needed to open the relief valve 245.

FIG. 4 shows the proportional grip circuit 150 in a gripping and torqueing mode. The torque controller 215 is actuated into a torqueing position such that fluid in fluid line 251 is in fluid communication with fluid lines 160 to supply fluid to the torqueing cylinders 112 to rotate the upper clamp assembly 115 in the torque direction identified by reference arrow TD to apply torque to the pin end 200A of the first tubular that is gripped by the upper clamp assembly 115. Fluid in the torqueing cylinders 112 may be returned to a reservoir 254 via fluid lines 165 through the torque controller 215.

The torque controller 215, when actuated into the torqueing position, also places fluid line 252 in fluid communication with fluid line 247. Fluid in fluid line 247 flows to the check valve 246, which directs the fluid to the relief valve 245 via fluid line 248. The check valve 246 may be a back-to-back check valve. The relief valve 245 may be a direct acting relief valve. Fluid flowing through the relief valve 245 flows into fluid line 234 and then to the reservoir 236. The relief valve 245 can be adjusted to control the amount of torque that is applied by the torqueing cylinders 112 to the upper clamp assembly 115. For example, if the relief valve 245 is configured to open when fluid in the fluid line 248 exceeds 500 psi, then the maximum amount of torque that the upper clamp assembly 115 can apply would be 500 psi since any pressurized fluid in excess of 500 psi would be relieved to the reservoir 236.

The torqueing force applied by the torqueing cylinders 112 is controlled solely by the relief valve 245. The gripping force applied by the upper and lower grip assemblies 125 and 130 is controlled solely by the relief valve 240 when the control valve 235 is in the open position. The gripping force applied by the upper and lower grip assemblies 125 and 130 is controlled by the combination of the relief valve 245 and the relief valve 240 when the control valve 235 is in the closed position.

When the proportional grip circuit 150 is in the gripping and torqueing mode as shown in FIG. 4, gripping force applied by the upper and lower grip assemblies 125 and 130 is proportional to the torqueing force applied by the torqueing cylinders 112, and specifically is proportionally offset by the amount of pressure at which the relief valve 240 is set to open. For example, if the relief valve 240 is set to open at about 500 psi, and the relief valve 245 is set to open at about 1,000 psi, then the maximum amount of torqueing force applied by the torqueing cylinders 112 would be 1,000 psi, while the maximum amount of gripping force applied by the upper and lower grip assemblies 125 and 130 would be 1,500 psi, which is a difference of 500 psi. If the pressure setting of the relief valve 245 is increased or decreased, then torqueing force applied by the torqueing cylinders 112 and the gripping force applied by the upper and lower grip assemblies 125 and 130 would increase or decrease by the same amount and would remain proportional to each other by a difference of 500 psi.

While the foregoing is directed to embodiments of the disclosure, other and further embodiments of the disclosure thus may be devised without departing from the basic scope thereof, and the scope thereof is determined by the claims that follow.

The invention claimed is:

1. A wrench assembly, comprising;

a lower clamp assembly having a plurality of first grip assemblies;

an upper clamp assembly coupled to the lower clamp assembly, the upper clamp assembly having a plurality of second grip assemblies and a plurality of torqueing cylinders coupled thereto; and a hydraulic circuit in fluid communication with the plurality of torqueing cylinders and each of the first and second grip assemblies, the hydraulic circuit comprising:

a first relief valve in fluid communication with the first and second grip assemblies, the first relief valve being configured to control a maximum amount of gripping force applied by the first and second grip assemblies; and a second relief valve in fluid communication with the plurality of torqueing cylinders, the second relief valve being configured to control a maximum amount of torqueing force applied by the plurality of torqueing cylinders, wherein the first and second relief valves are in fluid communication with each other such that a gripping force applied by the first and second grip assemblies is proportional to a torqueing force applied by the plurality of torqueing cylinders.

2. The wrench assembly of claim 1, wherein the hydraulic circuit comprises a first grip controller in fluid communication with the upper clamp assembly, and a second grip controller in fluid communication with the lower clamp assembly.

3. The wrench assembly of claim 2, wherein first grip controller is in fluid communication with a control valve that is biased into an open position.

4. The wrench assembly of claim 3, wherein the first and second grip controllers are in fluid communication with a first check valve.

5. The wrench assembly of claim 4, wherein the first check valve is in fluid communication with the first relief valve.

6. The wrench assembly of claim 5, wherein the first relief valve is preset, manually adjustable, or controlled remotely to set a pressure amount at which the first relief valve opens.

7. The wrench assembly of claim 6, wherein the first relief valve is in fluid communication with a second check valve and the control valve.

8. The wrench assembly of claim 7, wherein the second check valve is in fluid communication with the second relief valve.

9. The wrench assembly of claim 8, further comprising a torque controller in fluid communication with the second check valve and the second relief valve.

10. The wrench assembly of claim 9, wherein the second relief valve is preset, manually adjustable, or controlled remotely to set a pressure amount at which the second relief valve opens.

11. The wrench assembly of claim 10, wherein when the control valve is in a closed position, the combination of the first relief valve and the second relief valve controls the maximum amount of gripping force applied by the first and second grip assemblies.

12. A wrench assembly for applying torqueing force and gripping force to a tubular, comprising;

one or more grip assemblies actuated by one or more grip actuators;

a plurality of torqueing cylinders;

a first relief valve in fluid communication with the one or more grip assemblies and set to a first pressure at which the first relief valve opens;

a second relief valve in fluid communication with the plurality of torqueing cylinders and the first relief valve, the second relief valve being set to a second pressure at which the second relief valve opens;

wherein the second pressure of the second relief valve controls a maximum amount of torqueing force applied by the plurality of torqueing cylinders; and wherein a combination of the first pressure and the second pressure controls a maximum amount of gripping force applied by the one or more grip assemblies, the one or more grip assemblies being in fluid communication with the second relief valve through at least the first relief valve.

13. The wrench assembly of claim 12, wherein the first relief valve is in fluid communication with the one or more grip assemblies through at least a first check valve.

14. The wrench assembly of claim 13, wherein the second relief valve is in fluid communication with the plurality of torqueing cylinders through at least a second check valve.

15. The wrench assembly of claim 14, wherein the second relief valve is in fluid communication with the first relief valve through at least the second check valve.

16. The wrench assembly of claim 12, wherein the first and second relief valves are in fluid communication with each other such that a gripping force applied by the one or more grip assemblies is proportional to a torqueing force applied by the plurality of torqueing cylinders.

17. The wrench assembly of claim 12, further comprising a grip controller in fluid communication with the one or more grip assemblies and the first relief valve, and a torque controller in fluid communication with the plurality of torqueing cylinders and the second relief valve.

18. The wrench assembly of claim 17, further comprising a control valve in fluid communication with the first relief valve and the grip controller, and movable between an open position and a closed position.

19. The wrench assembly of claim 18, wherein when the control valve is in the open position, only the first pressure controls the maximum amount of gripping force applied by the one or more grip assemblies.

20. The wrench assembly of claim 19, wherein when the control valve is in the closed position, the combination of the first and second pressures controls the maximum amount of gripping force applied by the one or more grip assemblies.

* * * * *